United States Patent [19]

Franklin et al.

[11] Patent Number: 4,967,769

[45] Date of Patent: Nov. 6, 1990

[54] COMBINED FEEDER/CONDITIONER

[75] Inventors: Wilbur Franklin, Richmond; John Hudson, Jr., Mechanicsville, both of Va.

[73] Assignee: GBE International Plc, Hampshire, England

[21] Appl. No.: 318,690

[22] Filed: Mar. 3, 1989

[30] Foreign Application Priority Data

Mar. 4, 1988 [GB] United Kingdom ..... 8805220

[51] Int. Cl.[5] ..... A24B 3/18

[52] U.S. Cl. ..... 131/109.1; 131/302; 131/303; 131/304; 131/305; 131/306

[58] Field of Search ..... 131/302, 303, 304, 305, 131/306, 109.1

[56] References Cited

U.S. PATENT DOCUMENTS

| | | | |
|---|---|---|---|
| 3,335,730 | 8/1967 | Molins | 131/304 |
| 4,458,698 | 7/1984 | Brackmann | 131/109.1 |
| 4,572,218 | 2/1986 | Hing et al. | 131/304 |

*Primary Examiner*—V. Millin

*Attorney, Agent, or Firm*—Dowell & Dowell

[57] ABSTRACT

An apparatus for feeding and conditioning tobacco which includes a housing into which steam is supplied to treat tobacco being uniformly conveyed therethrough and wherein the inlet and outlet to the housing include rotating vanes for allowing for the passage of tobacco while restricting the discharge of steam.

15 Claims, 2 Drawing Sheets

COMBINED FEEDER/CONDITIONER

BACKGROUND OF THE INVENTION

This invention concerns the opening of tobacco cases after preconditioning, in particular bales of Oriental or Turkish or small leaf tobacco.

It is customary to store tobacco leaf in a dried condition at around 12% moisture content and compressed into packages in the form of wooden hogsheads, cardboard cases or hessian covered bales.

When these packages arrive at the factory for processing into cigarettes or other tobacco products they have to be opened, in the sense of separating the leaves, without breakage.

At 12% moisture content the leaf is fragile and easily broken, so the opening of the package is preceded by a conditioning process which heats and adds moisture to render the leaf supple. This is known as pre-conditioning.

The pre-conditioning process has to be effective while the leaves are still in the compressed package form, so it is normally carried out by a vacuum process, in which the air is evacuated from the package and replaced by steam which heats the tobacco and adds moisture by condensation, throughout the package.

Having pre-conditioned the leaves in the package it is then subjected to an opening process to separate the leaves and feed them to a further conditioning stage. This can be by hand, but is normally by a pin feed device known in the art as an "auto feed".

The auto feed comprises an elevating band conveyor set at approximately 55 degrees to the horizontal in the open, with an arrangement of pins on its surface. At the low end of the elevating band there is a hopper arrangement with a plain horizontal band conveyor.

The preconditioned package of tobacco is dumped into the hopper and conveyed toward the elevating band. The pins lift tobacco from the bulk in a layer. A doffer consisting of tines on a rotating shaft levels this layer to the depth of the pins, by throwing surplus leaf back into the hopper.

In practice this process does not totally separate the leaves and there are bunches or "pads" of leaves still sticking together in the product leaving the auto feed.

Because the preconditioning process adds moisture by condensation and heating the tobacco, the addition is limited to around 1% per 15 degrees C rise by the specific heat of the tobacco. This moisture can readily be lost by evaporation as the tobacco cools, so is only temporary moisture.

For the subsequent processing of the leaf, for example threshing or cutting, the leaf must be moistened to around 20% moisture content. The tobacco is therefore subjected to a further conditioning process in a rotating cylinder through which hot saturated air is circulated.

This conditioning cylinder is fitted with internal paddles or pins which lift and tumble the tobacco and reheat it again by condensation. The heat renders the tobacco receptive to the addition of permanent moisture by sprays which are directed into the cylinder.

The action of the cylinder further opens the leaf "pads", but some still remain in the discharge from the cylinder. These are undesirable for subsequent processing as the leaf within the "pads" does not experience the further conditioning and is thus still dry and would be degraded by the subsequent processing.

There is a particular problem with Oriental leaves where small bunches of leaves are threaded together for the curing stage. These tend to stick together in "pads" more persistently than leaves which are pressed together into a bale after curing.

It is usual to pass the discharge from the conditioning cylinder into a vertical air leg or classifier to separate the "pads" from the individual leaves; the "pads" being recirculated back to the auto feed for further treatment within the auto feed and cylinder.

CROSS-REFERENCE TO RELATED PATENT

One such separator, known as a low energy separator, which may be used is disclosed and claimed in our earlier British patent specification No. 1505946 (the entire contents of which are included in this disclosure by reference) hereinafter referred to as the "known separator".

OBJECTS OF THE INVENTION

It has been found that the known conditioning cylinder is not very effective at opening the "pads" of leaves.

It is an object of the invention to provide a combined auto feed and conditioning apparatus which is particularly but not exclusively, useful in treating such "pads" separated from the product leaving the conditioning cylinder.

SUMMARY OF THE INVENTION

According to the invention there is provided an apparatus for feeding and conditioning tobacco, comprising an enclosing housing, having an inlet and an outlet, a substantially horizontal first endless conveyor disposed beneath the inlet within the housing, an inclined endless conveyor within the housing having an arrangement of pins on its conveying surface, at least one doffer within the housing spaced from the inclined conveyor and serving to achieve a substantially constant thickness of tobacco being delivered by the inclined conveyor to the outlet, steam supply means within said housing and cell wheels provided respectively at the inlet and the outlet serving as air locks to prevent escape of steam while allowing flow of tobacco into and out of the housing.

Steam supply jets may be provided at the interior of the cell wheel at the inlet, preferably extending radially from the wheel hub.

Further according to the invention there is provided a system for conditioning and separating tobacco leaves comprising one or more separators of known type per se arranged to operate in parallel each with an inlet receiving conditioned tobacco, the separators each being arranged to discharge separated leaves from one outlet for further processing, while discharging any pads of unseparated leaves from a second outlet; an apparatus for feeding and conditioning tobacco as described in the preceding paragraphs, and an additional separator of known type per se similar to the one or more separators; the second outlets of all the separators being connected to the inlet of the feeding and conditioning apparatus and the outlet of the feeding and conditioning apparatus being connected to the inlet of the additional separator the first outlet of which discharges separated leaves to such further processing.

BRIEF DESCRIPTION OF THE DRAWINGS

The invention will now be described by way of example with reference to the accompanying drawings in which.

DETAILED DESCRIPTION OF PREFERRED EMBODIMENTS

Figure 1:
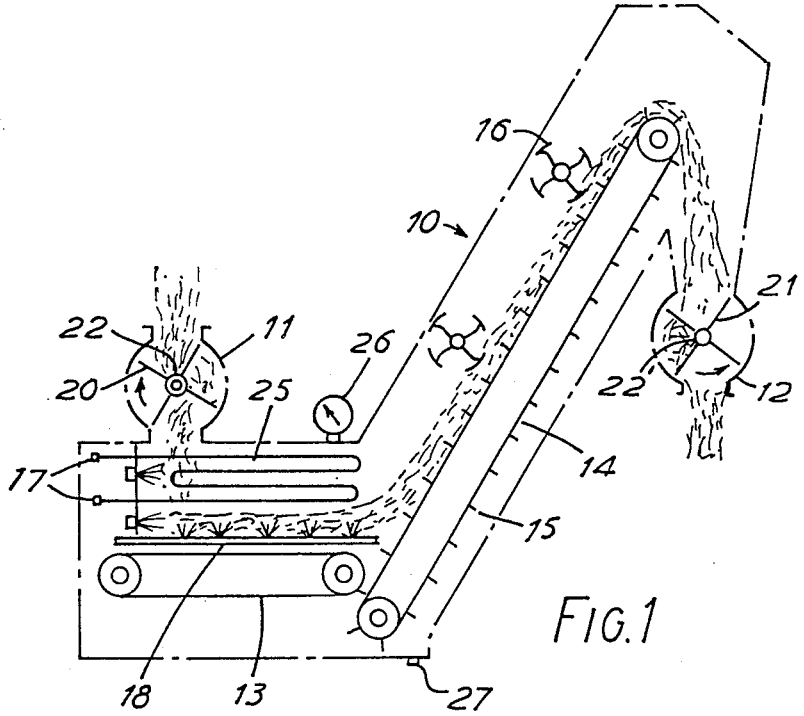
FIG. 1 is a side elevation of a feeder/conditioner shown schematically.

The arrangement shown in FIG. 1 comprises a housing 10 having an inlet 11 and an outlet 12, a horizontally disposed endless feed conveyor 13 disposed within the housing and arranged to receive tobacco entering through the inlet 11. A further endless conveyor 14 is arranged in the housing at an inclination of approximately 55 degrees to the horizontal. Pins 15 extend from the conveying surface of the conveyor 14 to engage the tobacco leaving the conveyor 13 and to convey it to the outlet 12. Rotatably driven doffers 16 are disposed adjacent the upper inclined surface of the conveyor 14 and serve to maintain a substantially constant thickness of tobacco on the conveyor 14 as it is fed to the outlet 12. The doffers 16 are driven at a speed proportional to the speed of the inclined conveyor 14. The housing 10 is preferably made of stainless steel and has removable covers. A steam supply is located in the region above the horizontal conveyor 13 and include rows of nozzles 17 and two rows of apertured pipes 18. The rows of steam nozzles 17 located at the rear of the feeder are directed toward the tobacco as it falls from the infeed air lock 11. Each row 17 is independently controlled by its own steam service control valve, complete with strainers to prevent the nozzles clogging.

The housing 10 totally encloses the conveyors, doffers and steam supply means with the exception of the inlet and outlets which are respectively provided with respective cell wheels 20, 21. The cell wheels are each provided with four radially extending vanes mounted on a hollow rotatable shaft 22. and 22: respectively The shaft 22 of the cell wheel at the inlet 11 is perforated or provided with nozzles which deliver jets of steam between the vanes.

The steam is fed to the hollow shaft 22 via a rotary union, a strainer and a steam service control valve (all not shown). The speed of rotation of the cell wheels 20 and 21 is independently controllable and proportional to the speed of travel of the conveyors 13 and 15.

Steam sponge pipes may be provided down each side of feed belt for steaming full area at bottom of the feeder, complete with associated strainer and steam service control valve.

The cell wheels 20, 21 serve to restrict egress of steam from the housing thus preventing a fall in temperature which is maintained at substantially 100° C. A heating coil 25 is provided in the housing 10, at each side in the region of the horizontal conveyor 13, and is supplied with steam independently of the steam supply to the tobacco. The steam supply to the coils 25 may be controlled by an on/off valve, a check valve, pressure gauge, a strainer and a steam trap (not shown).

Other features of the feeder/conditioner include independent control of the two conveyors and the provision of a temperature gauge 26 located at the end of the feed section and a condensate drain connection 27 located at the low point of the housing 10.

Figure 3:
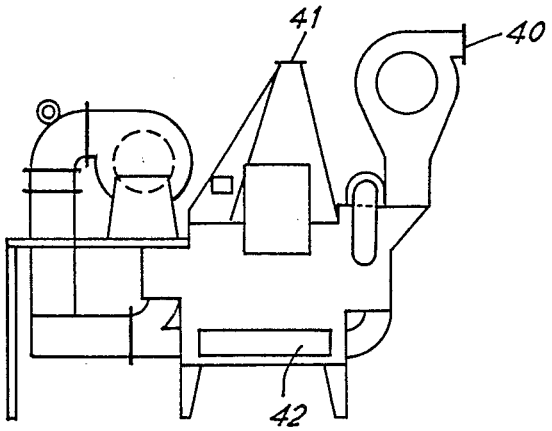
FIG. 3 is a side elevation of the "known separator" as hereinbefore defined.
Figure 4:
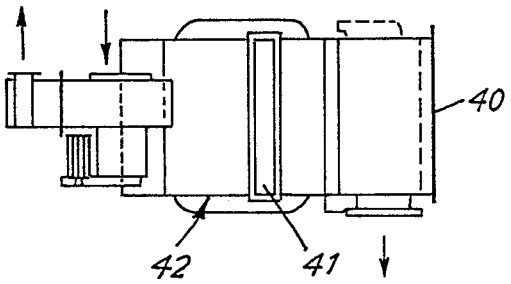
FIG. 4 is a plan view of the separator shown in FIG. 3.

The feeding and conditioning apparatus may be used in combination with any low energy separator of known type per se, particularly the "known separator" as herein defined and shown in outline only in FIGS. 3 and 4 of the accompanying drawings. In the "known separator" tobacco from the conditioning cylinder (not shown) enters an inlet 40 (FIGS. 3 and 4) and separated leaves or "lights" exit from a first outlet 41 while unseparated leaves or "heavies" exit in "pads" from a second outlet 42.

Figure 2:
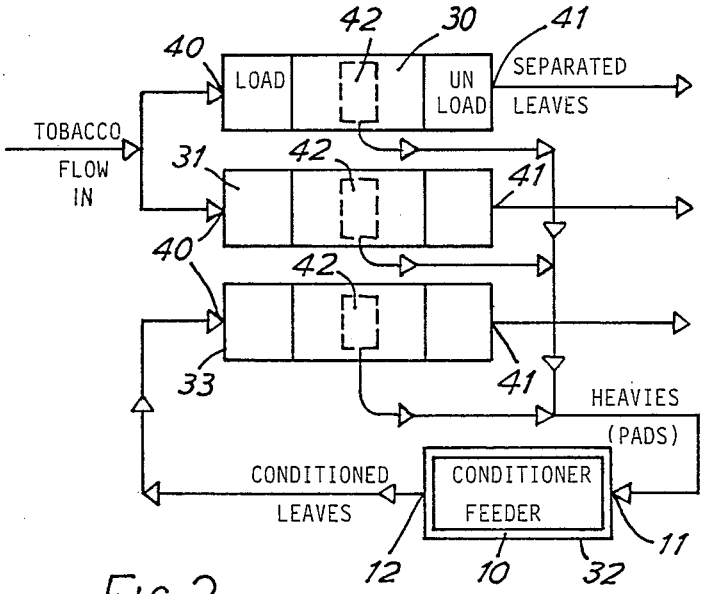
FIG. 2 is a schematic diagram of a system including a conditioner and a separator.

In the particular example shown outlined in FIG. 2 tobacco arrives from the conditioning cylinder (not shown) to the inlets 40 of a number of, in this case two, separators 30, 31 which are as shown in FIGS. 3 and 4, from which the unseparated bundles or pads of leaves are delivered from the outlets 42 to the inlet 11 of the conditioner/feeder, indicated at 32, of the kind described by way of example with reference to FIG. 1.

The conditioned tobacco from the conditioner/feeder 32 is passed to an additional separator 33, which is as shown in FIGS. 3 and 4. Any pads which drop out of the exit 42 from this additional separator are fed back to the additional conditioner/feeder 32 and continue to recirculate until they are opened and pass out of the inlet 41 of the separator 33 to further processing with the separated leaves from the separators 30 and 31.

The combination of the conditioner/feeder and the "known separator" of U.K. Patent Specification achieves an efficient separation of the leaves with minimal degradation.

In an alternative arrangement, the conditioner/feeder of FIG. 1 may be used to feed tobacco direct from the pre-conditioning stage to separators such as the known separators 30 and 31 in the arrangement of FIG. 2; without the provision of a conditioning cylinder, and optionally with or without the additional separator 33 with the associated conditioner/feeder 32. This is possible in some circumstances because the conditioner/feeder of FIG. 2 will achieve adequate conditioning and separation of the leaves in tobacco from the pre-conditioning stage.

What is claimed is:

1. Apparatus for feeding and conditioning tobacco, comprising an enclosing housing having an inlet and an outlet, a substantially horizontal first endless conveyor disposed beneath said inlet within said housing, said first conveyor having a receiving end and a discharge end, an inclined endless conveyor within said housing and having a lower end adjacent said discharge end of said first conveyor and an upper end from which tobacco is discharged to said outlet, said inclined conveyor having a conveying surface having a plurality of pins therein, at least one doffer means within said housing spaced from said inclined conveyor and serving to achieve a substantially constant thickness of tobacco being delivered by said inclined conveyor to said outlet, steam supply means within said housing, a cell wheel means provided respectively within said inlet and said outlet, said cell wheels including rotating vanes which serve to close said inlet and said outlet to thereby restrict the escape of steam while allowing flow of tobacco both into and out of said housing.

2. Apparatus as claimed in claim 1, in which said steam supply means includes at least one row of steam nozzles disposed above and adjacent said receiving end of said first endless conveyor.

3. Apparatus as claimed in claim 2, in which said cell wheel means within said inlet to said housing includes a hub, said hub including means for ejecting steam within said inlet.

4. Apparatus as claimed in claim 3, in which said steam supply means also includes at least one apertured steam pipe extending along and adjacent said first endless conveyor.

5. Apparatus as claimed in claim 1, including heating means disposed within said housing.

6. Apparatus as claimed in claim 5, wherein said heating means comprises at least one steam heated pipe.

7. An apparatus is claimed in claim 5, in which said steam supply means includes at least one row of steam nozzles disposed above and adjacent said receiving end of said first endless conveyor.

8. An apparatus is claimed in claim 7, in which said cell wheel means within said inlet to said housing includes a hub, said hub including means for ejecting steam within said inlet.

9. An apparatus is claimed in claim 8, in which said steam supply means also includes at least one apertured steamed pipe extending along and adjacent said first endless conveyor.

10. An apparatus is claimed in claim 5, in which said cell wheel means within said inlet to said housing includes a hub, said hub including means for ejecting steam within said inlet.

11. An apparatus is claimed in claim 1, in which said cell wheel means within said inlet to said housing includes a hub, said hub including means for ejecting steam within said inlet.

12. An apparatus is claimed in claim 1, in which said steam supply means also includes at least one apertured steam pipe extending along and adjacent said first endless conveyor.

13. An apparatus for conditioning and separating separated tobacco leaves from pads of tobacco leaves comprising, at least one separator for separating separate separated leaves from pads, said separator having an inlet and a first outlet for discharging separated tobacco leaves therefrom and a second outlet for discharging pads therefrom, a feeding and conditioning means, said feeding and conditioning means including a housing having an inlet and an outlet, a substantially horizontal first endless conveyor disposed within said inlet within said housing, said first conveyor having a receiving end and a discharged end, an inclined endless conveyor within said housing and having a lower and adjacent said discharge end of said first conveyor and an upper end from which tobacco is discharged to said outlet of said housing, at least one doffer means within said housing spaced from said inclined conveyor and serving to achieve a substantially constant thickness of tobacco being delivered by said inclined conveyor to said outlet of said housing, steam supply means within said housing, a cell wheel means provided respectively within said inlet and said outlet of said housing, said cell wheels including rotating vanes which serve to alternately close said inlet and said outlet of said housing to thereby restrict the escape of steam while allowing the flow of tobacco both into and out of said housing, and said inlet of said separator receiving separated and pads of tobacco from said outlet of said housing of said feeding and conditioning means.

14. The apparatus of claim 13, in which said steam supply means includes at least one row of steam nozzles disposed adjacent said first endless conveyor and heating means disposed within said housing.

15. The apparatus as claimed in claim 14, in which said cell wheel means within said inlet to said housing includes a hub, said hub including means for ejecting steam within said inlet.

* * * * *